US005831644A

United States Patent [19]

Kato

[11] Patent Number: 5,831,644

[45] Date of Patent: Nov. 3, 1998

[54] A RECORDING MEDIUM FEED MECHANISM AND MAINTENANCE MECHANISM, HAVING A COMMON DRIVE SOURCE, FOR AN INK JET PRINTER

[75] Inventor: Hiroyuki Kato, Nagoya, Japan

[73] Assignee: Brother Kogyo Kabushiki Kaisha, Nagoya, Japan

[21] Appl. No.: 733,602

[22] Filed: Oct. 18, 1996

[30] Foreign Application Priority Data

Oct. 20, 1995 [JP] Japan ..... 7-272752

[51] Int. Cl.[6] ..... B41J 2/165; B41J 2/01

[52] U.S. Cl. ..... 347/22; 347/104; 347/105

[58] Field of Search ..... 347/22, 101, 104, 347/105, 108, 30, 32; 271/22; 400/568, 569, 520, 545, 547.4, 567

[56] References Cited

U.S. PATENT DOCUMENTS 5,437,444 8/1995 Kawakami et al. ..... 271/22

FOREIGN PATENT DOCUMENTS 62-263058 11/1987 Japan .

*Primary Examiner*—Benjamin R. Fuller
*Assistant Examiner*—Thien Tran
*Attorney, Agent, or Firm*—Oliff & Berridge, PLC

[57] ABSTRACT

An ink jet printer in which a mechanism for carrying a recording medium and a mechanism for performing maintenance of a recording head are driven by a common driving source miniaturizing the printer. A carrier roller is arranged with both ends carried on side frames of a box whose upper surface has a carrying path for the recording medium. One side frame is arranged to carry a driving-force transmission mechanism for transmitting a driving force of a motor to the carrier roller. A maintenance mechanism having a suction cap, a pump and a cam for driving the pump is arranged externally of a second side frame. A maintenance driving-force transmission mechanism, for transmitting a driving force to the cam, is arranged internally of the second side frame. A transmission gear, meshed with a maintenance gear, is provided at one end of the carrier roller to enable the transmission of the driving force from the carrying driving-force transmission mechanism to the maintenance driving-force transmission mechanism.

14 Claims, 5 Drawing Sheets

61
53A
65
61A
53
55
51
57
67
63A
63
C
B
D

A RECORDING MEDIUM FEED MECHANISM AND MAINTENANCE MECHANISM, HAVING A COMMON DRIVE SOURCE, FOR AN INK JET PRINTER

BACKGROUND OF THE INVENTION

1. Field of the Invention

The invention relates to an ink jet printer in which a recording medium is used with a recording head for jetting ink. More specifically, the invention relates to an ink jet printer in which a mechanism for carrying the recording medium and a mechanism for performing maintenance of the recording head are driven by a common driving source.

2. Description of Related Art

In the past, in an ink jet printer, the provision of various maintenance means has been contemplated in order to prevent the image forming ability of a recording head from being lowered due to the ink remaining on the recording head. For example, there has been known an ink jet printer provided with wiper means for wiping of ink deposited on the surface of the recording head and suction means, such as a pump, for sucking ink within the recording head. In such a printer, a driving source for the roller carrying a recording medium also drives the maintenance means.

As such an ink jet printer as described above, for example, an ink jet printer has been known which comprises a recording head for jetting ink to a recording medium, a roller for carrying the recording medium passing a portion opposed to the recording head, a pair of side frames for rotatably supporting the roller, a carrying gear mechanism for transmitting a driving force from a driving source to the roller, maintenance means for performing maintenance on the recording head, and a maintenance gear mechanism for transmitting a driving force from the driving source to the maintenance means.

In the ink jet printer of this kind, the carrying gear mechanism and the maintenance gear mechanism are provided on the same side and externally of one of the side frames, the side frames being located on both sides in an axial direction of the roller. The carrying gear mechanism and the maintenance gear mechanism are positioned externally thereof in a line in an axial direction so that the length of the entire apparatus in the axial direction becomes long. Accordingly, in the ink jet printer of this kind, the printer can not be miniaturized sufficiently.

SUMMARY OF THE INVENTION

It is an object of the invention to provide an ink jet printer in which a mechanism for carrying a recording medium and a mechanism for performing maintenance of a recording head are driven by a common driving source, the printer being well miniaturized.

For achieving the aforesaid object, according to the invention, there is provided an ink jet printer comprising a recording head for jetting ink against a recording medium; a roller for carrying the recording medium passing a portion opposed to the recording head; a pair of side frames for rotatably supporting the roller at each end thereof; a carrying driving-force transmission mechanism provided on one of the side frames to transmit a driving force from a driving source to the roller; a maintenance means for performing the maintenance of the recording head; a maintenance driving-force transmission mechanism provided on the other of the side frames to transmit the driving force from the driving source to the maintenance means; and a transmission means for transmitting the driving force from the driving source to the maintenance driving-force transmission mechanism. The maintenance driving-force transmission mechanism is arranged internally of the other side frame, and the maintenance means is arranged adjacent the outside of the other side frame.

According to the invention, the transmission means transmits to the maintenance driving-force transmission mechanism the driving force transmitted through the carrying driving-force transmission mechanism from the driving source.

Further, according to the invention, a shaft of the roller is connected at one end to the carrying driving-force transmission mechanism, and the transmission means has a transmission gear connected to the other end of the shaft of the roller and meshed with the maintenance driving-force transmission mechanism.

According to the invention, the transmission gear is smaller in diameter than a diameter of the roller, and the maintenance driving-force transmission mechanism is provided on the side opposite to a carrying path of the recording medium with the transmission gear therebetween.

The invention further comprises a supply mechanism for supplying the recording medium to the roller, the carrying driving-force transmission mechanism capable of switching the driving force to the supply mechanism between transmission and non-transmission and vice versa.

According to the invention, the maintenance driving-force transmission mechanism is capable of switching the driving force to the maintenance means between transmission and non-transmission and vice versa.

According to the invention, the maintenance means has a suction means in which a pump is driven by the driving force transmitted through the maintenance driving-force transmission mechanism to suck ink in the recording head.

In the invention structured as described above, the maintenance gear mechanism is arranged internally of the other side frame, and the maintenance mechanism is arranged adjacent the outside of the other side frame. Therefore, the length of the entire apparatus becomes short enabling the miniaturization of the ink jet printer in a satisfactory manner.

The driving source for driving the carrying gear mechanism is disposed internally of the one side frame. In the invention, however, because the maintenance gear mechanism is provided on the other side frame, the maintenance gear mechanism can be provided simply internally of the other side frame. Further, as the transmission mechanism transmits the driving force from the driving source to the maintenance gear mechanism, the roller and the maintenance mechanism can be driven by the common driving source.

The invention is further characterized in that the transmission mechanism transmits the driving force transmitted through the carrying gear mechanism from the driving source to the maintenance gear mechanism. In the carrying gear mechanism, mechanisms rotated at various rotational speeds and torques (for example, a gear or a rotational shaft of a rotor) are present at various positions. Therefore, in the case where the driving force transmitted through the carrying gear mechanism is transmitted to the maintenance gear mechanism, the transmission of the driving force to the desired position at the desired rotational speed and torque can be achieved by a simple structure. Accordingly, according to the invention, there is provided the effect in that the structure of the transmission mechanism or the maintenance gear mechanism is simplified so that the ink jet printer can be further miniaturized.

Further, the invention is characterized in that the shaft of the roller is connected at one end to the carrying gear mechanism, and the transmission mechanism is provided with the transmission gear connected to the other end of the shaft and meshed with the maintenance gear mechanism. Because the roller is originally supported at both ends by the pair of side frames, the transmission mechanism can be constructed merely by providing the transmission gear on the roller. In the invention, the transmission mechanism comprises a very simple structure as described above, and therefore, thereby provides a further effect, in addition to the above-described effect, in that the ink jet printer can be further miniaturized.

The invention is further characterized in that the transmission gear is formed to be smaller in diameter than that of the roller, and the maintenance gear mechanism is provided on the side opposite to the carrier path of the recording medium with the transmission gear positioned therebetween. Therefore, it is possible to dispose the carrier path for the recording medium also on the portion opposed to the transmission gear. Thus, the carrier path can be disposed fully along the inside of the other side frame. Accordingly, the spacing between the pair of side frames can be narrowed to the width of the recording medium, and the ink jet printer can be further miniaturized.

Moreover, the invention is characterized by the provision of the supply mechanism for supplying the recording medium to the roller, and the carrying gear mechanism is capable of switching the driving force to the supply mechanism between transmission and non-transmission and vice versa. Because of this, in the case where only the maintenance mechanism is driven without carrying the recording medium, the transmission mode of the driving force from the carrying gear mechanism to the supply mechanism may be switched to the non-transmission mode. Accordingly, the driving timing of the maintenance mechanism can be set freely.

The invention is further characterized in that the maintenance mechanism is capable of switching the driving force to the maintenance mechanism between transmission and non-transmission and vice versa. Because of this, in the case where only the recording medium is desired to be carried without driving the maintenance mechanism, the transmission mode of the driving force from the maintenance gear mechanism to the maintenance mechanism may be switched to the non-transmission mode. Accordingly, there provides an effect, in addition to the previously described effect, that the driving state of the maintenance mechanism can be controlled freely.

In addition, the present invention is characterized in that the maintenance mechanism is provided with the suction mechanism which drives the pump by virtue of the driving force transmitted through the maintenance gear mechanism to suck ink within the recording head. In the maintenance mechanism of this kind which is necessary to drive the pump, the need to transmit the driving force to the maintenance mechanism increases. Accordingly, the effects of the invention described above are further conspicuous.

BRIEF DESCRIPTION OF THE DRAWINGS

A preferred embodiment of the invention will be described in detail with reference to the following figures, wherein.

DETAILED DESCRIPTION OF THE PREFERRED EMBODIMENT

Figure 1:
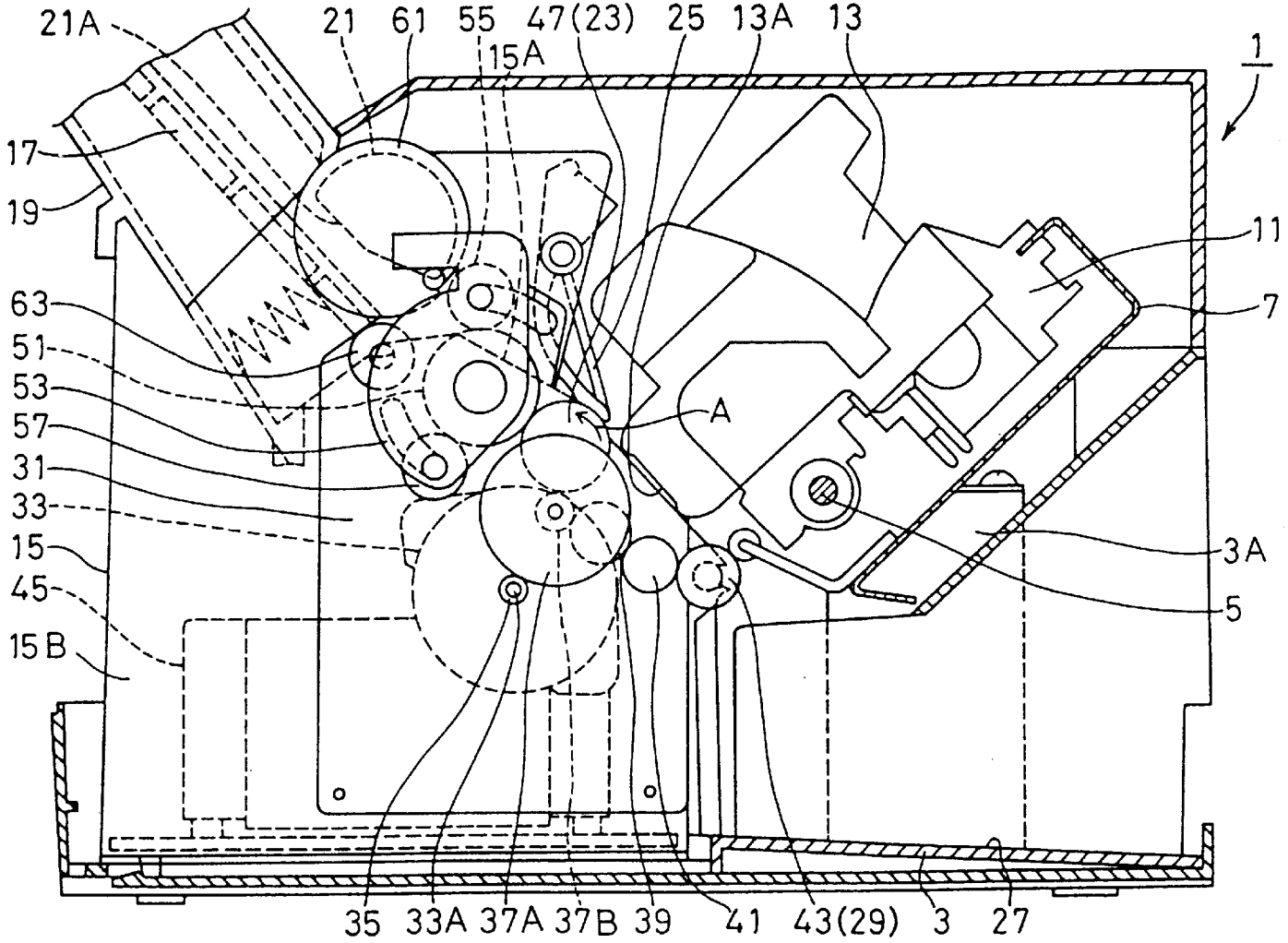
FIG. 1 is a longitudinal sectional view showing the structure of an ink jet printer to which the invention is applied.

The preferred embodiment of the invention will be described hereinafter with reference to the figures. FIG. 1 is a longitudinal sectional view showing the structure of an ink jet printer 1 to which the invention is applied. As shown in FIG. 1, in the ink jet printer 1, a columnar rail 5 is connected to end flanges (not shown) of a plate-like rail 7 which is secured to a support portion 3A mounted on a base frame 3, and a carriage 11 is provided movably along the rails 5, 7. An ink jet recording head 13 is mounted on the carriage 11. An ink jetting surface 13A of the recording head 13 is opposed to a box 15 made of resin secured onto the base frame 3.

A feeding cassette 19 provided with a paper holding bed 17 is detachably provided at the upper part of the box 15. On the upper side of the box is and contacting the surface of the paper holding bed 17 with a paper held therein, is a feeding roller 21 for drawing sheets of paper from the paper holding bed 17 sheet by sheet. A carrier roller 23 (which has the same axis as and the same diameter as a gear 47 to be described later) carries the sheets fed by the feeding roller 21 to the surface opposing ink jetting surface 13A. A paper presser 25 is placed in pressing contact with the carrier roller 23 by means of a biasing force of a spring (not shown) to press the paper, and a delivery roller 29 (which has the same axis and the same diameter as a gear 43 to be described later) is provided downstream, in the paper feed direction, for delivering the paper, having an image formed by the recording head 13, to a delivery tray 27 formed on the base frame 3. The surface of the box 15 constitutes a guide surface 15A for defining a carrier path of paper. A small diameter roller (not shown) is also provided at the extreme end of the paper presser 25, and the paper passes between the small diameter roller and the carrier roller 23.

The box 15 is provided with a pair of side frames 15B and 15C provided vertically on the base frame 3 (see FIG. 4), on both sides of the width of paper of the guide surface 15A. An iron plate 31 is secured to the outer surface of one side frame 15B (toward viewer of FIG. 1), the iron plate 31 being provided thereon with a carrying gear mechanism described below to drive the feeding roller 21, the carrier roller 23 and the delivery roller 29.

That is, the box 15 is interiorly provided with a driving source, for example, a reversibly rotatable motor 33, and a rotational shaft 33A thereof protrudes from the iron plate 31 and has a small diameter gear 35 secured thereto. The small diameter gear 35 meshes with a large diameter gear 37A, which is formed integrally with a small diameter gear 37B (hereinafter collectively called the gear 37 unless otherwise needing to be discriminated) The small diameter gear 37B meshes with the gear 43 which rotates integrally with the delivery roller 29 through gears 39, 41. A power device 45, for supplying power to the motor 33, is disposed within the box 15.

The small diameter gear 37B meshes with the gear 47 which rotates integrally with the carrier roller 23 (the gears 37A, 37B and 47 forming a carrying driving-force transmission mechanism), and the gear 47 is in turn meshed with a sun gear 51. A swinging frame 53 is provided for swinging on the rotational shaft of the sun gear 51, and planet gears 55, 57 meshed with the sun gear 51, are provided on both ends of the swinging frame 53. Because of this, the swinging frame 53 swings in the same direction as the rotational direction of the sun gear 51. The feeder roller 21 is further provided with a feeding gear 61 rotated integrally therewith. A gear 63, to be described later, is provided below the feeding gear 61. The sun gear 51, planet gears 55, 57, swinging frame 53, feeder roller 21, feeding gear 61, and gears 63 form a supply mechanism.

Figures 2A, 2B, 2C:
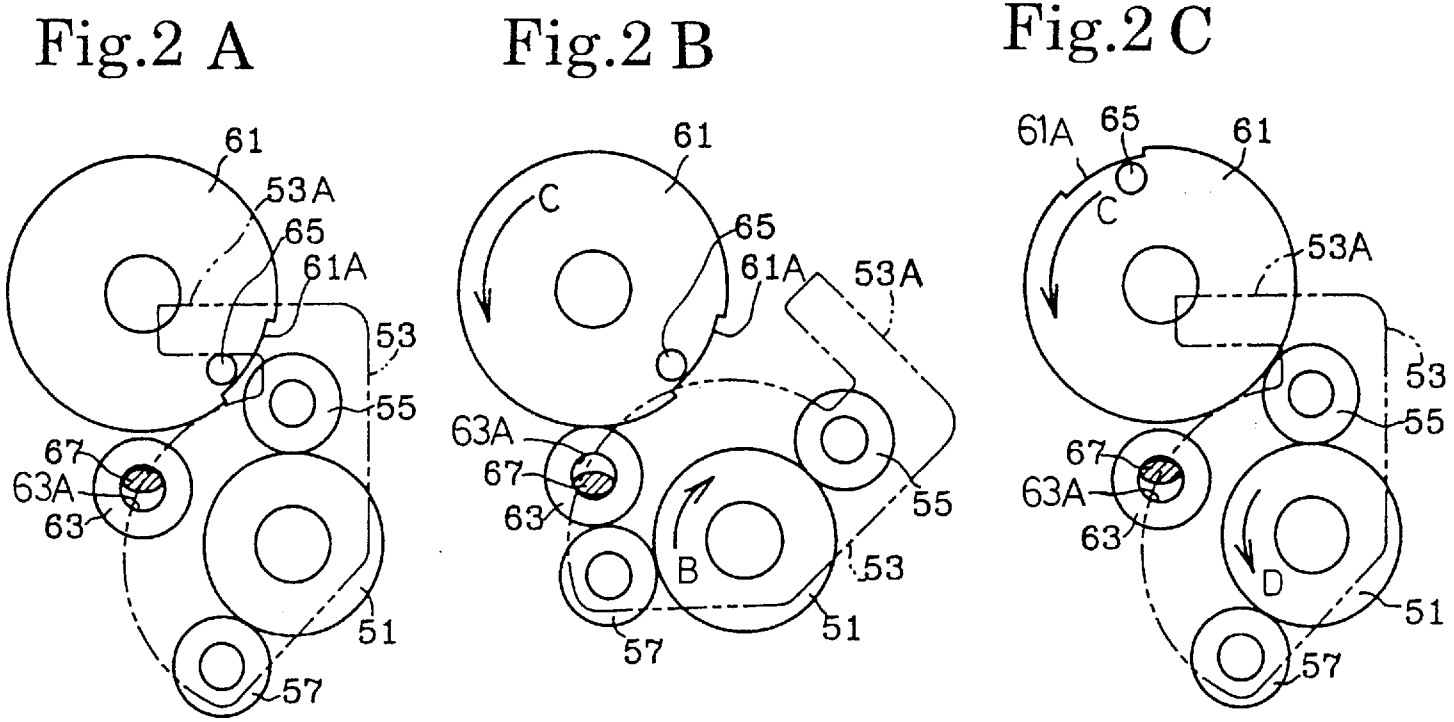
FIG. 2A is an explanatory view showing a gear mechanism in the vicinity of a feeding gear of the printer and the operation thereof.
FIG. 2B is an explanatory view showing a gear mechanism in the vicinity of a feeding gear of the printer and the operation thereof.
FIG. 2C is an explanatory view showing a gear mechanism in the vicinity of a feeding gear of the printer and the operation thereof.

FIGS. 2A to 2C are explanatory views showing the gear mechanism in the vicinity of the feeding gear 61 and the operation thereof. At the end, on the planet gear 55 side of the swinging frame 53, an engaging piece 53A is formed to project toward substantially the center of the feeding gear 61, and a pin 65 is provided on the surface of the feeding gear 61. The pin 65 and the engaging piece 53A are located so that they can be engaged with each other when the swinging frame 53 swings laterally and the feeding roller 21 is disposed at a stop position as described later. The feeding gear 61 has a notch 61A formed without teeth, the notch 61A being located so that it is opposed to the planet gear 55 when the pin 65 is engaged with the engaging piece 53A.

The gear 63 is provided with a circular hole 63A in the center thereof, the hole 63A being fitted on a shaft 67 projected from the box 15. The shaft 67 projects directly below the feeding gear 61 and has an oval section having a short axis directed vertically. This causes the gear 63 to be movable in a direction of the short axis of the oval. Further, the shaft 67 is located so that the gear 63 meshes with the feeding gear 61 when the gear 63 moves upward but does not mesh with the feeding gear 61 when the gear 63 moves downward.

With the above arrangement, when the carrier roller 23 rotates in the reverse direction (arrow A in FIG. 1) with respect to the direction of carrying paper, i.e., paper feed, the sun gear 51 rotates clockwise (arrow B), and the planet gear 57 meshes with the feeding gear 61 through the gear 63 as shown in FIG. 2B. Thereby, the feeding gear 61 rotates counterclockwise (arrow C: direction of carrying or feeding paper) integrally with the feeding roller 21 so that the paper is carried from the paper holding bed 17.

When carrier roller 23 rotates in the direction of carrying paper (reversed to arrow A), the sun gear 51 rotates counterclockwise (arrow D) as shown in FIG. 2C so that the planet gear 55 meshes with the feeding gear 61. Thereby, the feeding gear 61 rotates counterclockwise (arrow C) integrally with the feeding roller 21 to continue feeding paper. When the feeding roller 21 rotates to the stop position at which a cord portion 21A is opposed to the paper holding bed 17, the pin 65 is engaged with the engaging piece 53A, as shown in FIG. 2A, and the planet gear 55 is opposed to the notch 61A to inhibit the transmission of the driving force to the feeding gear 61 and the feeding roller 21.

Figure 3:
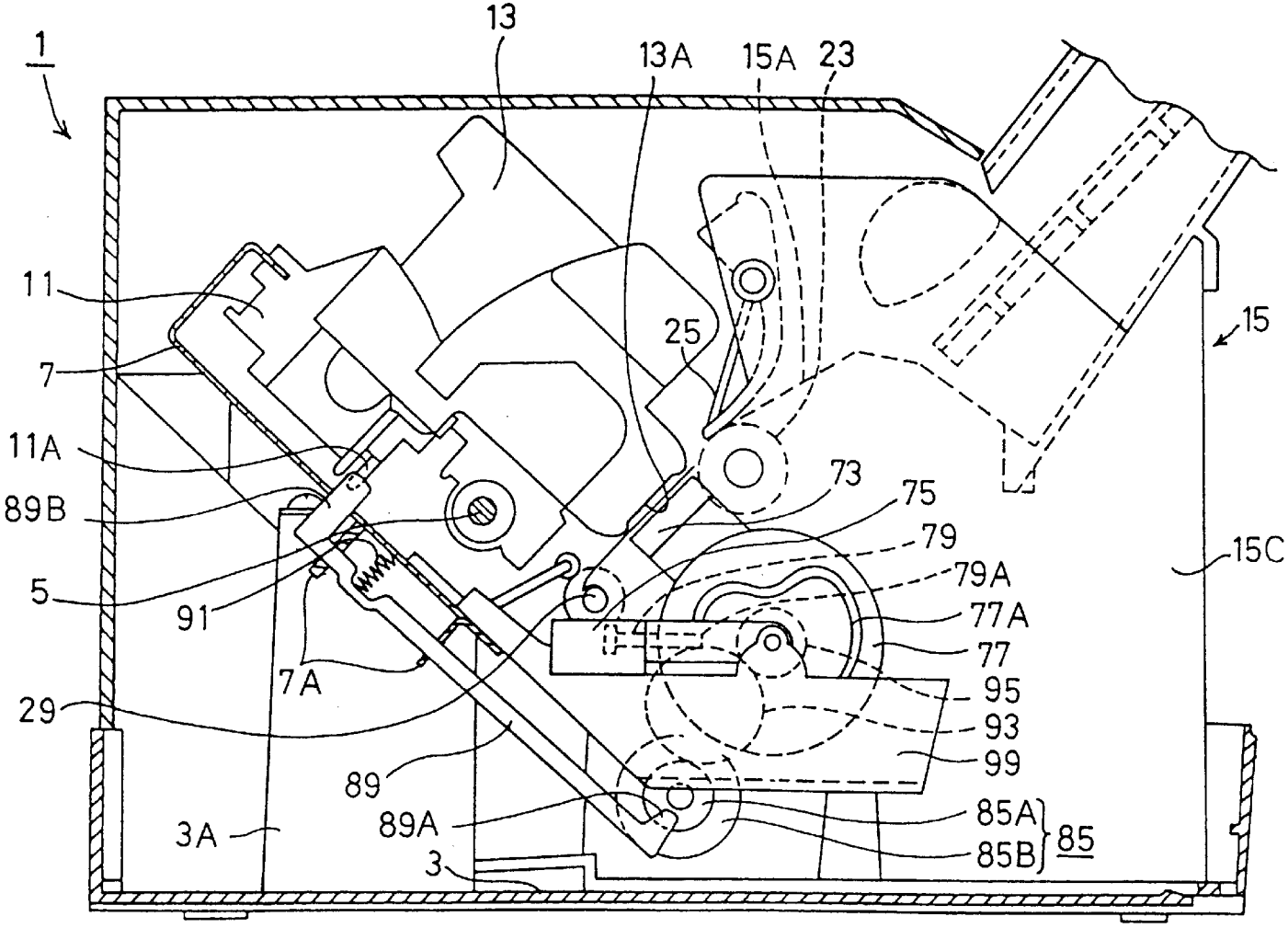
FIG. 3 is a longitudinal sectional view showing the structure of the printer taken on the side opposite to FIG. 1.
Figure 4:
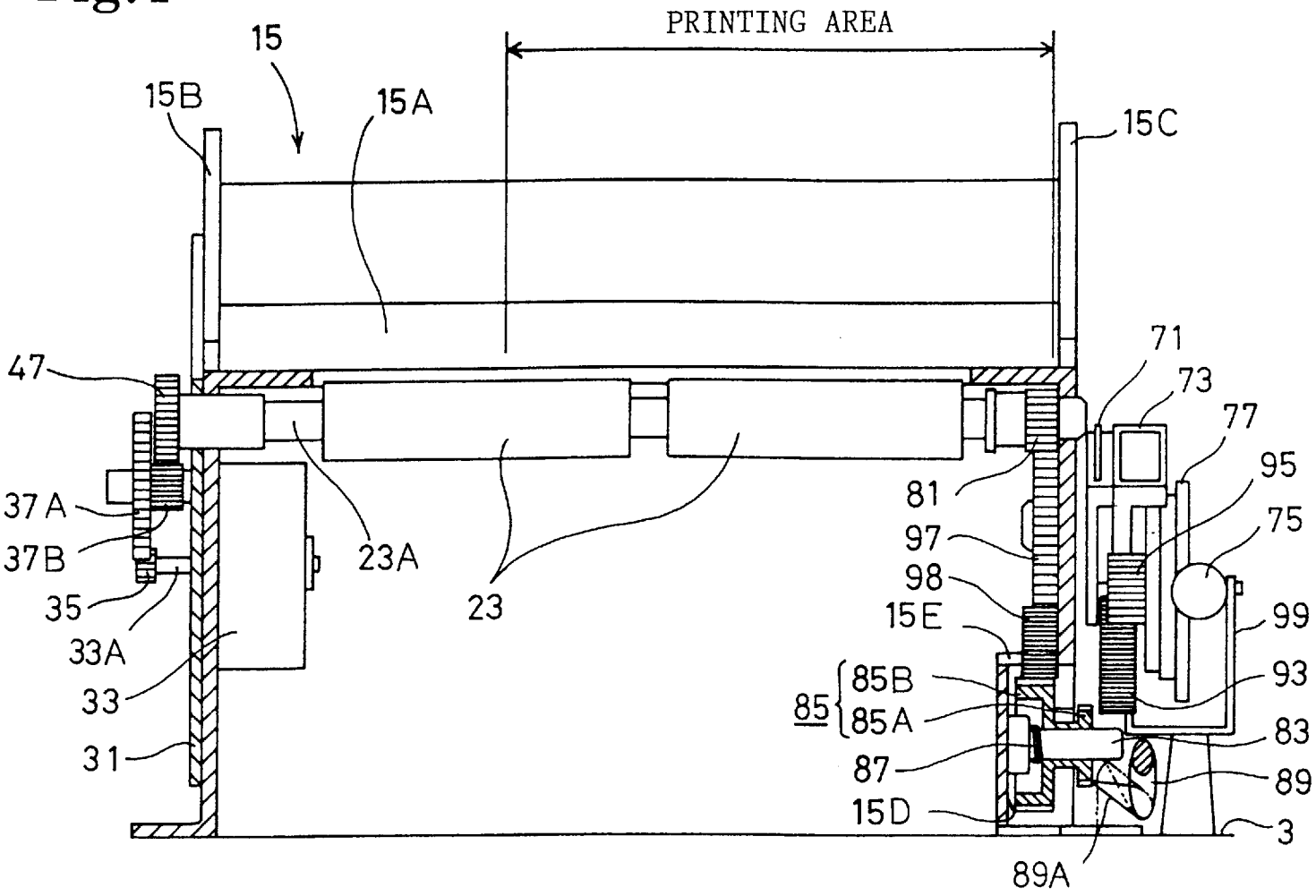
FIG. 4 is a cross-sectional view showing the structure of the printer taken in the vicinity of a carrier roller.

FIG. 3 is a longitudinal sectional view showing the structure with the ink jet printer 1 taken on the side frame 15C side. FIG. 4 is a cross-sectional view showing the structure of the ink jet printer 1 from the vicinity of the carrier roller 23. As shown in FIGS. 3 and 4, adjacent to the outside of the side frame 15C (outside the printing area) is a maintenance mechanism. More specifically, the maintenance mechanism comprises a wiper 71 (FIG. 4) for wiping the ink jetting surface 13A of the recording head 13, and a suction mechanism for sucking ink within the ink jetting ports of the ink jetting surface 13A, that is, a suction cap 73 and a pump 75. When the recording head 13 moves to the position opposite to the wiper 71 or the suction cap 73, the wiper 71 and the suction cap 73 come in close contact with the ink jetting surface 13A by virtue of the rotation of a cam 77. The pump 75 causes the interior of the suction cap 73 to have a negative pressure by sliding a piston 79 (FIG. 3) as the cam 77 rotates. That is, a proximal end 79A of the piston 79 is in engagement with a cam groove 77A of the cam 77 and slides along the cam groove 77A when the cam 77 rotates. By this operation, the piston 79 slides to suck ink from the suction cap 73 while in close contact with the ink jetting surface 13A.

Figure 5:
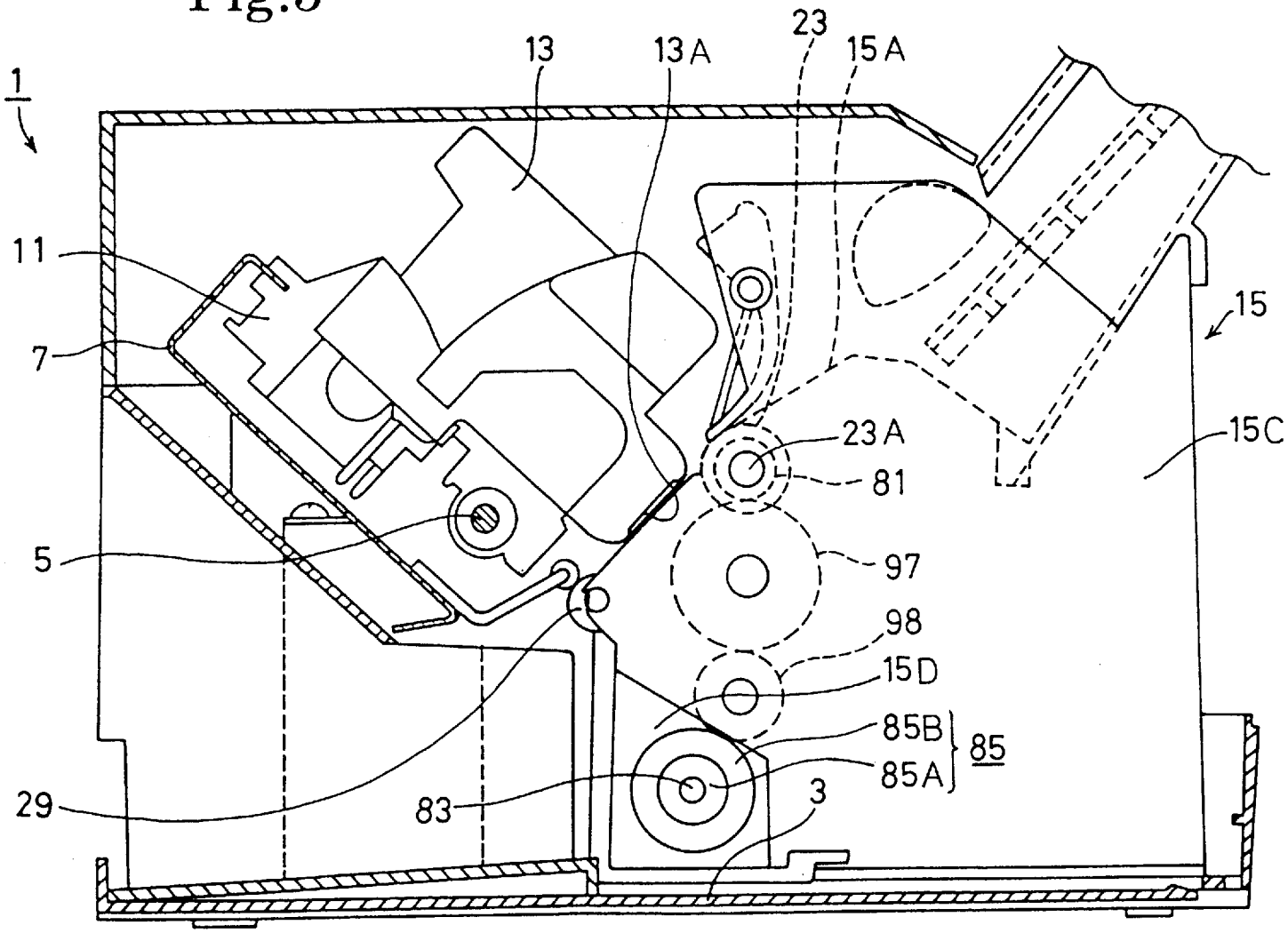
FIG. 5 is a longitudinal sectional view corresponding to FIG. 3 but with the maintenance mechanism removed.

As shown in FIGS. 4 and 5, a maintenance gear mechanism is provided on the side frame 15C, as described later, and the cam 77 is driven by this mechanism. More specifically, the rotational shaft 23A of the carrier roller 23 has opposite ends supported by the side frames 15B,15C. The aforementioned gear 47 is secured integrally with the end of the rotational shaft 23A at the side frame 15B. To the other end of the rotational shaft 23A is secured a transmission gear 81 disposed internally of the side frame 15C and having a diameter smaller than the carrier roller 23. With this arrangement, the gear 47, the carrier roller 23 and the transmission gear 81 rotate together through the rotational shaft 23A so that the driving force transmitted through the carrying gear mechanism from the motor 33, with the rotational shaft 23A and the transmission gear 81 being the transmission mechanism, is transmitted to the maintenance gear mechanism.

The maintenance gear mechanism is structured as follows. An inwardly depressed recess 15D is formed at the lower end of the side frame 15C, and a shaft 83 is provided horizontally from the recess 15D toward the outside. A gear 85, integrally comprising a small diameter gear 85A and a large diameter gear 85B is mounted rotatably and slidably on the shaft 83. A spring 87 (FIG. 4) is disposed between the gear 85 and the recess 15D to bias the gear 85 outwardly.

Gears 97, 98 connect the transmission gear 81 and the large diameter gear 85B and are supported internally of the side frame 15C. The gear 98 is partly exposed from a hole 15E formed in the upper wall surface of the recess 15D and meshes with the large diameter gear 85B (see FIG. 5). The gear 98 is always meshed with the large diameter gear 85B irrespective of the sliding of the gear 85.

The carrier roller 23 has its partial outer circumference exposed or projected upwardly above the guide surface 15A but is mostly below the guide surface 15A as the transmission gear 81 is smaller in diameter than the carrier roller 23. With this, the maintenance gears 97, 98, 85, forming a maintenance driving-force transmission mechanism, are also located below the guide surface 15A, that is, on the side opposite to the guide surface 15A with the transmission gear 81 forming a transmission means, therebetween. Accordingly, the carrier path can be formed along the whole side frame 15C without being obstructed by the transmission gear 81 and the maintenance gears 97, 98, 85. Thus, paper can be carried while being contacted or guided by the inner surface of the side frame 15C.

The small diameter gear 85A is meshed with or disengaged from the gears 93, 95 connected to the cam 77 when the gear 85 is slidably moved by the lever 89 to switch the driving force to the cam 77 between transmission and non-transmission.

The lever 89 is pivotally mounted on the shaft support 7A provided on the undersurface of the plate like rail 7 and has a proximal end 89B projected onto the plate like rail 7. Further, the lever 89 has its extreme end 89A biased, by means of a spring 91 provided between the lever 89 and the rail 7, in a direction of pressing the gear 85 against the biasing of the spring 87 (counterclockwise in FIG. 4). The biasing force of the spring 91 is greater than that of the spring 87 and, normally (during formation of an image, for example), the extreme end 89A of the lever 89 presses the gear 85 to disengage the small diameter gear 85A from the gear 93. That is, the transmission of the driving force to the cam 77 is inhibited. When the carriage 11 moves the recording head 13 to the position opposed to the suction cap 73 and the pawl 11A, provided at the lower part of the carriage 11, presses the proximal end 89B of the lever 89, the extreme end 89A rotates in the direction of moving away from the side frame 15C, as indicated by the two-dot contour line, and the gear 85 is slidably moved in the direction of causing the small diameter gear 85A to mesh with the gear 93 by the biasing force of the spring 87.

The wiper 71, the suction cap 73, the pump 75, the cam 77 and the gears 93, 95 are supported on the base frame 3 by a support frame 99.

The operation of the ink jet printer 1 structured as described above will be explained hereinafter. In normal image formation, the motor 33 is first rotated from the FIG. 2A state counterclockwise (hereinafter called reversal) in FIG. 1. Then, the gear 47 to which turning force is transmitted through the gear 37 rotates counterclockwise (arrow A: reverse to the paper carrying direction) integrally with the carrier roller 23, and the gear 43 to which turning force is transmitted through the gears 37, 39, 41 also rotates counterclockwise (reverse to the paper carrying direction) integrally with the delivery roller 29. At this time, the feeding roller 21 rotates in the paper carrying direction (arrow C in FIG. B) as described previously. Accordingly, paper on the paper holding bed 17 is carried toward the carrier roller 23. However, since the carrier roller 23 rotates in the direction reversed to the paper carrying direction, the leading end of paper impinges upon the contact portion between the carrier roller 23 and the roller of the paper presser 25. Paper is flexed between the feeding roller 21, the carrier roller 23 and the roller of the paper presser 25 so that the leading end of paper is positioned parallel to the axis of the carrier roller 23.

Subsequently, when the motor 33 rotates normally, the rotation, reversed to that just described, is transmitted to the gears 37 to 47. Because of this, the carrier roller 23 and the delivery roller 29 rotate in the paper carrying direction, and the paper whose leading end impinges upon the carrier roller 23 and the roller of the paper presser 25 is engaged by the rollers and carried to the position opposed to the recording head 13. An image produced by the recording head 13 is formed on the paper, which is then delivered to the delivery tray 27. Also at this time, the feeding roller 21 continues to rotate in the paper carrying direction till it reaches the stop position as described above. Even if the feeding roller 21 stops, the rotation of the carrier roller 23 continues and the tail end of paper is drawn out passing under the cord portion 21A of the feeding roller 21.

During the image formation as described above, the carriage 11 reciprocates at the position opposed to the paper carrying path and the lever 89 is not pressed by the pawl 11A. Accordingly, no driving force is transmitted to the maintenance mechanism.

On the other hand, when the maintenance of the recording head 13 is executed by the maintenance mechanism, paper is not preset in the carrying path and the planet gear 55 opposes the notch 61A of the feeding gear 61 to inhibit the transmission of the driving force to the feeding roller 21. This state, the carriage 11 is moved to the position at which the ink jetting surface 13A of the recording head 13 opposes the suction cap 73. At that time, the proximal end 89 of the lever 89 is pressed by the pawl 11A so that the small diameter gear 85A meshes with the gear 93. When the motor 33 rotates normally in this state, the driving force of the motor 33 is transmitted, in order of the gears 37, 47, the rotational shaft 23A, the gears 81, 97, 98, 85, 93, 95 to rotate the cam 77. Thereby, the suction cap 73 first advances toward the recording head 13 and comes in close contact with the ink jetting surface 13A. Subsequently, the pump 75 is driven to suck ink within the ink jetting ports of the ink jetting surface 13A. Further, after the suction cap 73 has been retracted, the wiper 71 advances and the carriage 11 moves in a direction of returning to the print area. Then, the ink jetting surface 13A is wiped by the wiper 71 to remove ink on the surface.

In the ink jet printer described above, the gears 35, 37, 47 for rotating the carrier roller 23 are arranged on one side frame 15B whereas the gears 81, 85, 97, 98 for rotating the cam 77 are arranged on the other side frame 15C. Further, the maintenance mechanism, such as the wiper 71 and the suction cap 73, is arranged adjacent to the outside of the side frame 15C. Because of this, the entire length can be shortened, and the ink jet printer 1 can be miniaturized. While the motor 33 is disposed internally of the side frame 15B, it is to be noted that in the ink jet printer 1, because the gears 81 to 98 are provided on the opposite side frame 15C, the gears 81 to 98 can be disposed simply.

Further, in the ink jet printer 1, with the transmission gear 81 provided on the rotational shaft 23A of the carrier roller 23, the driving force transmitted through the gear mechanism on one side frame 15B is transmitted to the gear mechanism on the other side frame 15C. Therefore, a particular transmission mechanism need not be provided and the structure is simplified. Moreover, the transmission gear 81 is formed to be smaller in diameter than that of the carrier roller 23, and paper can be carried over the guide surface 15A without interference by the transmission gear 81. Therefore, the carrier path can be disposed fully along the inside of the side frame 15C (see FIG. 4), and the spacing between the side frames 15B and 15C can be narrowed. Accordingly, the ink jet printer 1 can be further miniaturized.

Further, in the ink jet printer 1, when the feeding roller 21 is disposed at the stop position, even if the feeding roller 23 is rotated in the paper carrying direction, the feeding roller 21 is not rotated and new paper is not supplied. Therefore, without carrying paper, the cam 77 can be rotated and suction by means of the suction cap 73 can be obtained. Further, since the gear 85 is slidably provided, the cam 77 rotates only when the ink jetting surface 13A is opposed to the suction cap 73. Therefore, it is possible to prevent wasteful driving of the pump 75 thereby reducing power consumption of the motor 33 as compared with the case where the cam 77 always rotates during the rotation of the carrier roller 23.

In the above-described embodiment, the motor 33, the gears 35, 37 and 47, the gears 85, 97 and 98, the transmission gear 81 and the rotational shaft 23A, and the paper holding bed 17, the feeding roller 21 and the feeding gear 61, and the suction cap 73, the pump 75 and the cam 77 correspond to the driving source, the carrying gear mechanism, the maintenance gear mechanism, the transmission mechanism, the supply mechanism, and the suction mechanism, respectively. The invention is not limited to the above-described embodiment in any way, but can be variously embodied within the scope without departing from the subject matter of the invention.

For example, the gear 85 may be fixedly disposed at a position in which the small diameter gear 85A meshes with the gear 93 and the pump 75 is always driven. In this case, the lever 89 may be omitted to simplify the entire apparatus, but the pump 75 is wastefully driven so that the power consumption slightly increases.

Further, while in the above-described embodiment, the wiper 71 and the suction cap 73 are driven by the maintenance gear mechanism, they can be driven by means of a link mechanism using the moving force of the carriage 11 as is well known. If the wiper 71 and the suction cap 73, along with the pump 75, are always driven by the cam 77, the necessity of transmitting the driving force of the driving source for the motor 33 increases. Accordingly, In the above-described embodiment, the effect of the invention is further conspicuous.

What is claimed is:

1. An ink jet printer having a recording head for jetting ink against a recording medium located in a print area, comprising:

a pair of side frames, a driving source mounted to a first side frame of said pair of side frame;

a roller for carrying the recording medium to pass a portion opposed to said recording head;

said pair of side frames for rotatably supporting both ends of said roller; a carrying driving-force transmission mechanism provided on a first side frame of said pair of side frames to transmit a driving force from said driving source to said roller;

a maintenance means for performing maintenance of said recording head, said maintenance means is arranged adjacent a side of said second side frame facing away from the print area;

a maintenance driving-force transmission mechanism provided on a second side frame of said pair of side frames to transmit the driving force from said driving source to said maintenance means; and a transmission means for transmitting the driving force from said roller to said maintenance driving-force transmission mechanism, wherein said maintenance driving-force transmission mechanism is arranged on a side of said second side frame facing toward the print are.

2. The ink jet printer as claimed in claim 1, wherein said transmission means transmits to said maintenance driving-force transmission mechanism the driving force transmitted through said carrying driving-force transmission mechanism from said driving source.

3. The ink jet printer as claimed in claim 1, wherein a shaft of said roller is connected at a first end to said carrying driving-force transmission mechanism, and said transmission means has a transmission gear connected to a second end of said shaft of said roller and meshed with said maintenance driving-force transmission mechanism.

4. The ink jet printer as claimed in claim 3, wherein said transmission gear is smaller in diameter than that of said roller, and said maintenance driving-force transmission mechanism is provided on a side opposite to a carrying path of said recording medium with said transmission gear therebetween.

5. The ink jet printer as claimed in claim 1, further comprising:

a supply mechanism for supplying said recording medium to said roller, said carrying driving-force transmission mechanism switching the driving force to said supply mechanism between transmission and non-transmission and vice versa.

6. The ink jet printer as claimed in claim 1, wherein said maintenance driving-force transmission mechanism switches the driving force to said maintenance means between transmission and non-transmission and vice versa.

7.The ink jet printer as claimed in claim 1, wherein said maintenance means has a suction means in which a pump is driven by the driving force transmitted through said maintenance driving-force transmission mechanism to suck ink from said recording head.

8. An ink jet printer, comprising:

a pair of side frames;

a roller rotatably mounted between the pair of side frames for feeding a print medium across a platen surface;

a carriage mounting at least one printer head;

a drive source;

a first drive transmission linkage connecting the drive source and the roller, the first drive transmission linkage mounted to a first side frame of the pair of side frames;

a maintenance means for cleaning the at least one print head;

a second drive transmission linkage connecting the roller to the maintenance means, the second drive transmission linkage mounted to a surface of a second side frame of the pair of side frames facing the first side frame; and a supply mechanism for feeding the print medium from a source position, the supply mechanism connected to the first drive transmission linkage and switchable between a supplying state and a non-supplying state.

9. The ink jet printer as claimed in claim 8, wherein the maintenance means is mounted to a surface of the second side frame facing away from the first side frame.

10. The ink jet printer as claimed in claim 8, wherein an end of the roller mounted in the second side frame has a transmission gear integral therewith, the transmission gear having a smaller diameter than the roller.

11. The ink jet printer as claimed in claim 10, wherein a print medium feed path passes over the transmission gear.

12. The ink jet printer as claimed in claim 9, wherein an end of the roller rotatably mounted in the first side frame has a gear integral therewith, the gear engaged with the supply mechanism.

13. The ink jet printer as claimed in claim 12, wherein the supply mechanism comprises:

a sun gear engaged with the gear integral to the rollers;

a swing frame pivotal about a rotational axis of the sun gear;

a pair of planetary gears mounted to the swing frame and engaged with the sun gear, the pair of planetary gears separated from one another;

a feeding gear of a feed roller;

a linking gear, wherein the feeding gear is engaged by the linking gear for the feeding of the print medium.

14. The ink jet mechanism as claimed in claim 8, wherein the maintenance means comprises:

a suction pump; and a suction cap for capping a print head of the at least one print head wherein the pump is driven by a drive force from the drive source and transmitted through the first drive transmission linkage, the roller, and the second drive transmission linkage.

* * * * *